US008369770B2

(12) United States Patent
Okamoto et al.

(10) Patent No.: US 8,369,770 B2
(45) Date of Patent: Feb. 5, 2013

(54) COLLECTION CONTAINER, CLEANING UNIT, AND IMAGE FORMING APPARATUS CAPABLE OF COLLECTING WASTE TONER EFFICIENTLY

(75) Inventors: Michiya Okamoto, Zama (JP); Hiroyuki Nagashima, Yokohama (JP); Fumihito Itoh, Kawasaki (JP); Hiroshi Ono, Tokyo (JP); Ken Amemiya, Tokyo (JP); Masahiko Shakuto, Zama (JP); Toshio Koike, Machida (JP); Yuji Arai, Kawasaki (JP); Kaoru Yoshino, Tokyo (JP); Takuma Iwasaki, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 494 days.

(21) Appl. No.: 12/461,998

(22) Filed: Aug. 31, 2009

(65) Prior Publication Data

US 2010/0080600 A1 Apr. 1, 2010

(30) Foreign Application Priority Data

Sep. 29, 2008 (JP) ..... 2008-250314

(51) Int. Cl.
*G03G 21/12* (2006.01)

(52) U.S. Cl. ..... 399/360

(58) Field of Classification Search ..... 399/360
See application file for complete search history.

(56) References Cited

U.S. PATENT DOCUMENTS 6,157,792 A * 12/2000 Mori et al. ..... 399/24
6,298,217 B1 * 10/2001 Murayama et al. ..... 399/358
7,366,440 B2 * 4/2008 Horikawa ..... 399/111
7,603,056 B2 * 10/2009 Kamimura ..... 399/110
2004/0052560 A1 * 3/2004 Ishii et al. ..... 399/360
2005/0036810 A1 * 2/2005 Murakami et al. ..... 399/360
2006/0024103 A1 * 2/2006 Murakami et al. ..... 399/360
2006/0039710 A1 * 2/2006 Tawada ..... 399/35
2006/0045573 A1 * 3/2006 Yamaguchi et al. ..... 399/254
2006/0216066 A1 * 9/2006 Kubota et al. ..... 399/257
2007/0092290 A1 * 4/2007 Murakami et al. ..... 399/110
2007/0104523 A1 * 5/2007 Yoshida et al. ..... 399/358
2007/0196147 A1 * 8/2007 Nada et al. ..... 399/358
2007/0292179 A1 * 12/2007 Kudo ..... 399/358
2008/0187332 A1 * 8/2008 Tsuda et al. ..... 399/27
2008/0187377 A1 * 8/2008 Kagawa ..... 399/358

(Continued)

FOREIGN PATENT DOCUMENTS

JP 10-177329 6/1998
JP 11305623 A * 11/1999

(Continued)

OTHER PUBLICATIONS

Machine translation of JP-11-305623.*

(Continued)

*Primary Examiner* — Walter L Lindsay, Jr.
*Assistant Examiner* — David Bolduc
(74) *Attorney, Agent, or Firm* — Harness, Dickey & Pierce P.L.C.

(57) ABSTRACT

A collection container for collecting and containing waste toner includes a leveling member, a detector, and at least one inlet. The leveling member levels the waste toner contained in the collection container. The detector detects an amount of the waste toner contained in the collection container. The leveling member levels the waste toner delivered to the collection container through the at least one inlet by conveying the waste toner simultaneously in a first direction toward the detector and a second direction opposite to the first direction, starting from an origination position corresponding to the at least one inlet.

15 Claims, 5 Drawing Sheets

U.S. PATENT DOCUMENTS

| | | | | |
|---|---|---|---|---|
| 2008/0317483 | A1* | 12/2008 | Tanimoto et al. | 399/35 |
| 2009/0074468 | A1* | 3/2009 | Iwata et al. | 399/254 |
| 2009/0097879 | A1 | 4/2009 | Nagashima et al. | |
| 2009/0257799 | A1* | 10/2009 | Haruno et al. | 399/360 |
| 2010/0021212 | A1* | 1/2010 | Sumii | 399/262 |

FOREIGN PATENT DOCUMENTS

| | | |
|---|---|---|
| JP | 2002-148884 | 5/2002 |
| JP | 2004-102137 | 4/2004 |
| JP | 3577689 | 7/2004 |

OTHER PUBLICATIONS

Machine translation of JP 2002-148884.*

Abstact of JP 11-003015 published Jan. 6, 1999.

Office Action dated Dec. 23, 2011 issued in corresponding Chinese Application No. 200910178908.0.

Japanese office communication dated Nov. 13, 2012, issued in Japanese Patent Application No. 2008-250314.

* cited by examiner

COLLECTION CONTAINER, CLEANING UNIT, AND IMAGE FORMING APPARATUS CAPABLE OF COLLECTING WASTE TONER EFFICIENTLY

PRIORITY STATEMENT

The present patent application claims priority from Japanese Patent Application No. 2008-250314, filed on Sep. 29, 2008, in the Japan Patent Office, which is hereby incorporated herein by reference in its entirety.

BACKGROUND OF THE INVENTION

1. Field of the Invention

Example embodiments generally relate to a collection container, a cleaning unit, and an image forming apparatus, and more particularly, to a collection container for collecting and containing waste toner, and a cleaning unit and an image forming apparatus each of which includes the collection container.

2. Description of the Related Art

Related-art image forming apparatuses, such as copiers, facsimile machines, printers, or multifunction printers having at least one of copying, printing, scanning, and facsimile functions, typically form an image on a recording medium (e.g., a recording sheet) according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

In such image forming apparatuses, the cleaner removes residual toner (e.g., waste toner) not used for forming the toner image and therefore remaining on the surface of the image carrier from the surface of the image carrier. The removed waste toner is collected into a collection container. When the collection container is full of waste toner, the collection container is replaced with another empty collection container.

Market demand for compact image forming apparatuses may require, among other things, that the collection container be capable of collecting waste toner efficiently in order to reduce the frequency of replacement of the collection container.

To address such demand, a toner sensor may be provided in an upper portion of the collection container outside the collection container to detect waste toner collected and accumulated in the collection container. When the toner sensor detects the waste toner, a user is notified that the collection container is full of waste toner. However, the waste toner may accumulate unevenly, concentrating in only a part of the collection container, and consequently the toner sensor may indicate that the collection container is full when it is not.

To address this problem, the collection container may further include a swing mechanism for swinging or shaking the collection container periodically. However, the swing mechanism may generate noise, and the toner sensor may need to be provided inside the collection container, resulting in increased manufacturing costs for the collection container. Further, the user may need to electrically connect the swing mechanism of the collection container to a power source whenever the user replaces the collection container with another empty one.

Alternatively, the collection container may include an agitation screw provided in an upper portion of the collection container to even out the accumulated waste toner to provide more accurate sensor readings. However, particularly with compact image forming apparatuses, the space available for the collection container is restricted, requiring that the collection container assume a complex shape in order to fit into the available space. When the collection container has a complex shape, the agitation screw may not even out the accumulated waste toner properly because the waste toner may not be evenly accumulated inside the collection container.

To address this problem, the collection container with a complex shape may include a circulation mechanism for circulating the waste toner in the complex collection container. The circulation mechanism may include a leveling member for circulating the waste toner in the complex collection container and a driver for driving the leveling member. However, the leveling member moves the waste toner in one direction only, generating a dead space not containing the waste toner inside the collection container.

SUMMARY

At least one embodiment may provide a collection container that collects and contains waste toner and includes a leveling member, a detector, and at least one inlet. The leveling member levels the waste toner contained in the collection container. The detector detects an amount of the waste toner contained in the collection container. The leveling member levels the waste toner delivered to the collection container through the at least one inlet by conveying the waste toner simultaneously in a first direction toward the detector and a second direction opposite to the first direction, starting from an origination position corresponding to the at least one inlet.

At least one embodiment may provide a cleaning unit that includes a cleaner for collecting waste toner, a collection container for collecting and containing the waste toner collected by the cleaner, and a conveyer for conveying the waste toner collected by the cleaner to the collection container. The collection container includes a leveling member, a detector, and at least one inlet. The leveling member levels the waste toner contained in the collection container. The detector detects an amount of the waste toner contained in the collection container. The leveling member levels the waste toner delivered to the collection container through the at least one inlet by conveying the waste toner simultaneously in a first direction toward the detector and a second direction opposite to the first direction, starting from an origination position corresponding to the at least one inlet.

At least one embodiment may provide an image forming apparatus that includes a collection container detachably attached to the image forming apparatus. The collection container collects and contains waste toner and includes a leveling member, a detector, and at least one inlet. The leveling member levels the waste toner contained in the collection container. The detector detects an amount of the waste toner contained in the collection container. The leveling member levels the waste toner delivered to the collection container through the at least one inlet by conveying the waste toner simultaneously in a first direction toward the detector and a second direction opposite to the first direction, starting from an origination position corresponding to the at least one inlet.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
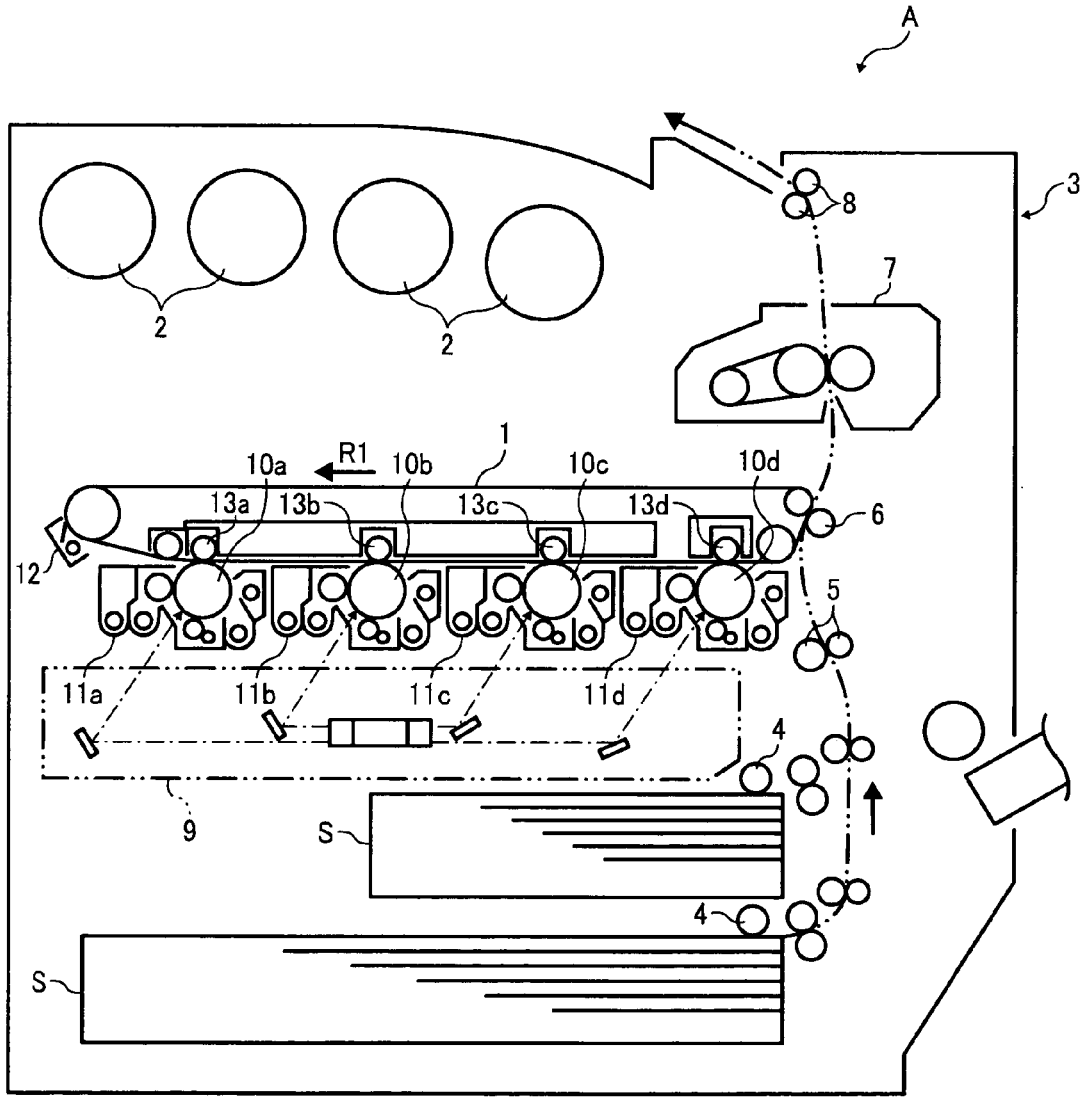
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms a "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all-technical equivalents that operate in a similar manner.

Referring now to the drawings, wherein like reference numerals designate identical or corresponding parts throughout the several views, particularly to FIG. 1, an image forming apparatus A according to an example embodiment is explained.

FIG. 1 is a schematic view of the image forming apparatus A. As illustrated in FIG. 1, the image forming apparatus A includes a body 3. The body 3 includes an intermediate transfer belt 1, toner bottles 2, feed rollers 4, a registration roller pair 5, a second transfer roller 6, a fixing unit 7, an output roller pair 8, a writing unit 9, process cartridges 11*a*, 11*b*, 11*c*, and 11*d*, a belt cleaner 12, and/or first transfer rollers 13*a*, 13*b*, 13*c*, and 13*d*.

The process cartridges 11*a*, 11*b*, 11*c*, and 11*d* include photoconductive drums 10*a*, 10*b*, 10*c*, and 10*d*, respectively.

Figure 2:
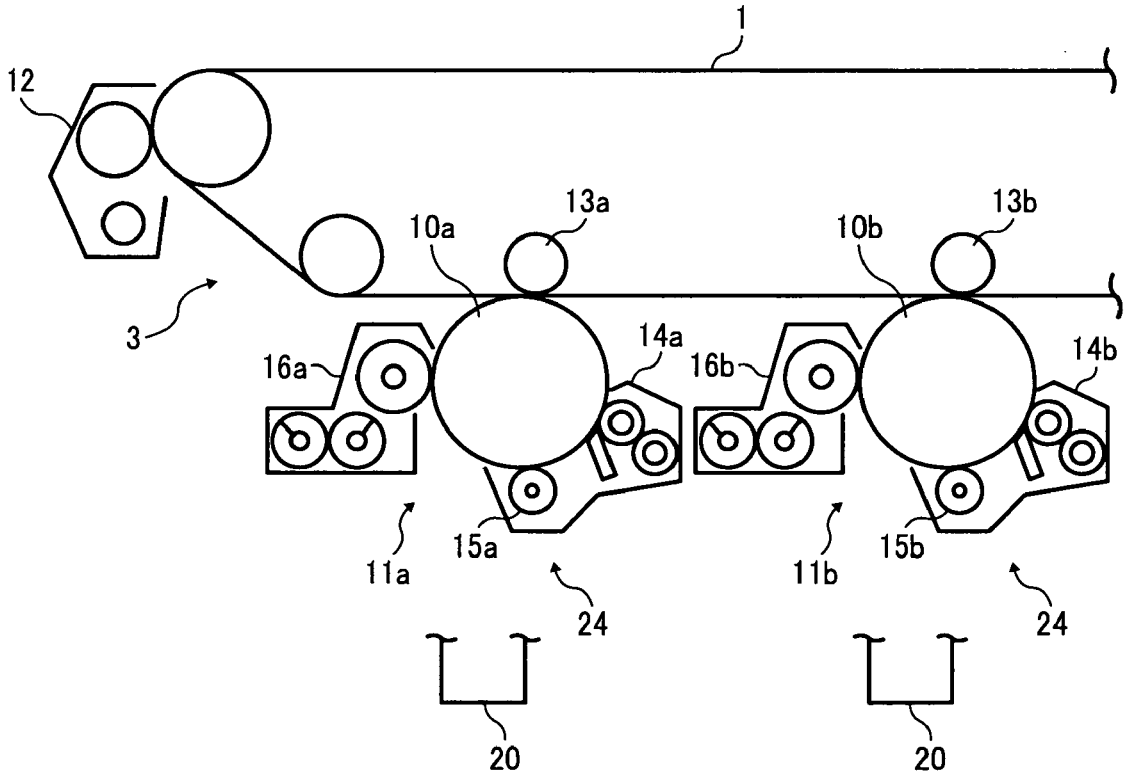
FIG. 2 is a partially enlarged view (according to an example embodiment) of a body included in the image forming apparatus shown in FIG. 1.

FIG. 2 is a partially enlarged view of the body 3. As illustrated in FIG. 2, the body 3 further includes cleaning units 24. The cleaning units 24 include cleaners 14*a*, 14*b*, 14*c*, and 14*d* and/or waste toner bottles 20, respectively. The process cartridges 11*a*, 11*b*, 11*c*, and 11*d* further include the cleaners 14*a*, 14*b*, 14*c*, and 14*d*, chargers 15*a*, 15*b*, 15*c*, and 15*d*, and/or development devices 16*a*, 16*b*, 16*c*, and 16*d*, respectively. In FIG. 2, the cleaners 14*c* and 14*d*, the chargers 15*c* and 15*d*, and the development devices 16*c* and 16*d* are omitted.

As illustrated in FIG. 1, the image forming apparatus A can be a copier, a facsimile machine, a printer, a multifunction printer having at least one of copying, printing, scanning, plotter, and facsimile functions, or the like. According to this example embodiment of the present invention, the image forming apparatus A functions as a tandem color printer for forming a color image on a recording medium.

The process cartridges 11*a*, 11*b*, 11*c*, and 11*d* serve as process cartridges detachably attached to the image forming apparatus A, respectively. The photoconductive drums 10*a*, 10*b*, 10*c*, and 10*d* serve as image carriers or photoconductors, respectively. As illustrated in FIG. 2, the cleaners 14*a*, 14*b*, 14*c*, and 14*d* serve as cleaners for cleaning the image carriers (e.g., photoconductive drums 10*a*, 10*b*, 10*c*, and 10*d*), respectively. The chargers 15*a*, 15*b*, 15*c*, and 15*d* serve as chargers for charging surfaces of the image carriers, respectively. The development devices 16*a*, 16*b*, 16*c*, and 16*d* serve as development devices for developing electrostatic latent images formed on the image carriers into toner images, respectively.

According to this example embodiment, the process cartridges (e.g., the process cartridges 11*a*, 11*b*, 11*c*, and 11*d*) include the image carriers (e.g., the photoconductive drums 10*a*, 10*b*, 10*c*, and 10*d*) and the cleaners (e.g., the cleaners 14*a*, 14*b*, 14*c*, and 14*d*), respectively. Alternatively, each of the process cartridges may include the image carrier and at least one of the charger, the development device, and the cleaner. For example, the image carrier and at least one of the charger, the development device, and the cleaner are integrated into a unit as the process cartridge detachably attached to the image forming apparatus A.

As illustrated in FIG. 1, yellow, cyan, magenta, and black toner images formed on the photoconductive drums 10*a*, 10*b*, 10*c*, and 10*d*, respectively, are transferred and superimposed onto the intermediate transfer belt 1 so that a color toner image is formed on a surface of the intermediate transfer belt 1. The toner bottles 2 contain yellow, cyan, magenta, and black toners to be used for forming the yellow, cyan, magenta, and black toner images on the photoconductive drums 10*a*, 10*b*, 10*c*, and 10*d*, respectively. The intermediate transfer belt 1 and the toner bottles 2 are provided inside the body 3. A transfer sheet S serving as a recording medium loaded in a lower portion of the body 3 is sent to the intermediate transfer belt 1 so that the color toner image formed on the surface of the intermediate transfer belt 1 is transferred onto the transfer sheet S. After the fixing unit 7 fixes the color toner image on the transfer sheet S, the transfer sheet S is discharged to an outside of the image forming apparatus A at an upper portion of the image forming apparatus A.

For example, one of the feed rollers 4 feeds a transfer sheet S from the lower portion toward the upper portion of the image forming apparatus A. The registration roller pair 5 feeds the transfer sheet S fed by the feed roller 4 to the second transfer roller 6 at a time at which the color toner image formed on the intermediate transfer belt 1 is transferred onto the transfer sheet S properly. The second transfer roller 6 opposes and contacts the intermediate transfer belt 1 to apply a reference pressure to the intermediate transfer belt 1 so as to form a nip portion between the second transfer roller 6 and the intermediate transfer belt 1. The fixing unit 7 applies heat and pressure to the transfer sheet S bearing the color toner image sent from the second transfer roller 6. The output roller pair 8 discharges the transfer sheet S to the outside of the image forming apparatus A. In other words, while the transfer sheet S is conveyed in a conveyance path formed by the feed roller 4, the registration roller pair 5, the second transfer roller 6, the intermediate transfer belt 1, the fixing unit 7, and the output roller pair 8, the color toner image formed on the intermediate transfer belt 1 is transferred onto the transfer sheet S at the nip portion formed between the second transfer roller 6 and the intermediate transfer belt 1. Thereafter, the fixing unit 7 fixes the color toner image on the transfer sheet S.

The process cartridges 11*a*, 11*b*, 11*c*, and 11*d* serve as four image stations for forming yellow, cyan, magenta, and black toner images, which are transferred and superimposed onto the intermediate transfer belt 1 to form a color toner image. The process cartridges 11*a*, 11*b*, 11*c*, and 11*d* are arranged along a longitudinal direction of the intermediate transfer belt 1 which may be slanted diagonally left up in FIG. 1, and include the photoconductive drums 10*a*, 10*b*, 10*c*, and 10*d*, respectively. The photoconductive drums 10*a*, 10*b*, 10*c*, and 10*d* are pressed against the first transfer rollers 13*a*, 13*b*, 13*c*, and 13*d* via the intermediate transfer belt 1, respectively. As illustrated in FIG. 2, the chargers 15*a*, 15*b*, 15*c*, and 15*d*, the development devices 16*a*, 16*b*, 16*c*, and 16*d*, and the cleaners 14*a*, 14*b*, 14*c*, and 14*d* surround the photoconductive drums 10*a*, 10*b*, 10*c*, and 10*d*, respectively. However, in FIG. 2, the process cartridges 11*c* and 11*d* are omitted.

As illustrated in FIG. 1, the writing unit 9 is provided below the process cartridges 11*a*, 11*b*, 11*c*, and 11*d* to emit laser beams onto the surfaces of the photoconductive drums 10*a*, 10*b*, 10*c*, and 10*d* to form electrostatic latent images on the surfaces of the photoconductive drums 10*a*, 10*b*, 10*c*, and 10*d*, respectively. The belt cleaner 12 serves as a cleaner for cleaning the surface of the intermediate transfer belt 1 by removing residual toner remaining on the surface of the intermediate transfer belt 1.

The toner bottles 2 are arranged from left to right in FIG. 1 in the upper portion of the image forming apparatus A to supply yellow, cyan, magenta, and black toners to the process cartridges 11*a*, 11*b*, 11*c*, and 11*d*, respectively. The toner bottles 2 are detachably attached to the image forming apparatus A, and contain the yellow, cyan, magenta, and black toners, respectively. The toner bottles 2 are connected to the development devices 16*a*, 16*b*, 16*c*, and 16*d* depicted in FIG. 2 via toner supply paths, respectively, so that the yellow, cyan, magenta, and black toners contained in the toner bottles 2 are supplied to the development devices 16*a*, 16*b*, 16*c*, and 16*d*, respectively, in a given supply amount.

Referring to FIGS. 1 and 2, the following describes operations of the image forming apparatus A. The chargers 15*a*, 15*b*, 15*c*, and 15*d* uniformly charge the surfaces of the photoconductive drums 10*a*, 10*b*, 10*c*, and 10*d*, respectively. The writing unit 9 scans and exposes the charged surfaces of the photoconductive drums 10*a*, 10*b*, 10*c*, and 10*d* by emitting laser beams onto the charged surfaces of the photoconductive drums 10*a*, 10*b*, 10*c*, and 10*d*, so as to form electrostatic latent images on the surfaces of the photoconductive drums 10*a*, 10*b*, 10*c*, and 10*d*, respectively. The development devices 16*a*, 16*b*, 16*c*, and 16*d* make the electrostatic latent images formed on the surfaces of the photoconductive drums 10*a*, 10*b*, 10*c*, and 10*d* visible as yellow, cyan, magenta, and black toner images with yellow, cyan, magenta, and black toners supplied from the toner bottles 2, respectively. Thus, the yellow, cyan, magenta, and black toner images are formed on the surfaces of the photoconductive drums 10*a*, 10*b*, 10*c*, and 10*d*, respectively. The first transfer rollers 13*a*, 13*b*, 13*c*, and 13*d* are applied with a voltage to transfer the yellow, cyan, magenta, and black toner images formed on the surfaces of the photoconductive drums 10*a*, 10*b*, 10*c*, and 10*d*, respectively, onto the surface of the intermediate transfer belt 1 successively. For example, the yellow, cyan, magenta, and black toner images formed on the surfaces of the photoconductive drums 10*a*, 10*b*, 10*c*, and 10*d*, respectively, are transferred onto the surface of the intermediate transfer belt 1 at different times which begin with transfer from the photoconductive drum 10*a* disposed upstream from the photoconductive drums 10*b*, 10*c*, and 10*d* and end with transfer from the photoconductive drum 10*d* disposed downstream from the photoconductive drums 10*a*, 10*b*, and 10*c* in a rotation direction R1 of the intermediate transfer belt 1, so that the yellow, cyan, magenta, and black toner images are superimposed on a same position on the surface of the intermediate transfer belt 1 to form a color toner image on the surface of the intermediate transfer belt 1.

On the other hand, when a leading edge of a transfer sheet S fed by the feed roller 4 reaches the registration roller pair 5, a sensor detects the leading edge of the transfer sheet S, and generates a detection signal. The registration roller pair 5 feeds the transfer sheet S to the nip portion formed between the second transfer roller 6 and the intermediate transfer belt 1 in accordance with the detection signal in synchronism with the color toner image formed on the intermediate transfer belt 1. Accordingly, the color toner image formed on the intermediate transfer belt 1 is transferred onto the transfer sheet S at the nip portion formed between the second transfer roller 6 and the intermediate transfer belt 1. The transfer sheet S bearing the color toner image is sent to the fixing unit 7 which applies heat and pressure to the transfer sheet S bearing the color toner image to fix the color toner image on the transfer sheet S. Thereafter, the transfer sheet S bearing the fixed color toner image is sent to the output roller pair 8. The output roller pair 8 discharges the transfer sheet S bearing the fixed color toner image onto the outside of the image forming apparatus A.

Waste toner (e.g., yellow, cyan, magenta, and black toners) generated during the above-described operations of the image forming apparatus A is collected from the photoconductive drums 10*a*, 10*b*, 10*c*, and 10*d* and discharged from the process cartridges 11*a*, 11*b*, 11*c*, and 11*d*, respectively. For example, the cleaners 14*a*, 14*b*, 14*c*, and 14*d* remove residual toner not used for developing the electrostatic latent images into the toner images and therefore remaining on the surfaces of the photoconductive drums 10*a*, 10*b*, 10*c*, and 10*d* from the surfaces of the photoconductive drums 10*a*, 10*b*, 10*c*, and 10*d*, respectively, so that the removed toner is collected as waste toner. Similarly, the belt cleaner 12 removes residual toner not transferred onto the transfer sheet S and therefore remaining on the surface of the intermediate transfer belt 1 from the surface of the intermediate transfer belt 1, so that the removed toner is collected as waste toner.

Figure 3A:
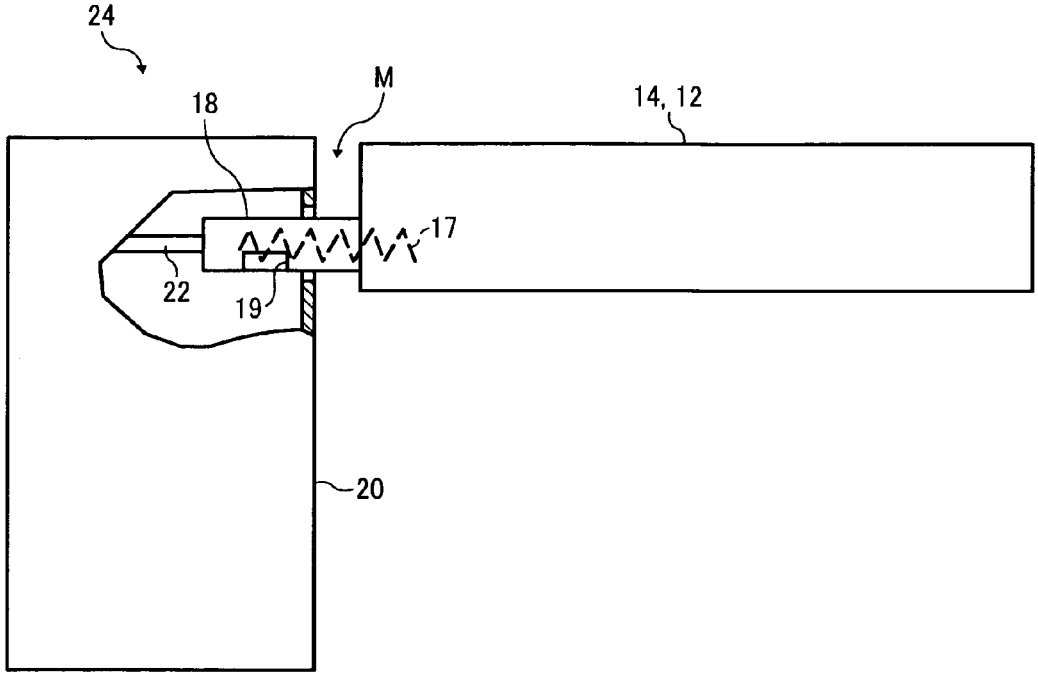
FIG. 3A is a schematic view (according to an example embodiment) of a cleaning unit included in the body shown FIG. 2.

FIG. 3A is a schematic view of the cleaning unit 24. In FIG. 3A, each of the cleaners 14*a*, 14*b*, 14*c*, and 14*d* depicted in FIG. 2 is shown as a cleaner 14. As illustrated in FIG. 3A, the cleaning unit 24 includes the cleaner 14 or the belt cleaner 12, the waste toner bottle 20, and/or a waste toner moving mechanism M. The waste toner moving mechanism M includes a waste toner conveying screw 17, a waste toner discharge pipe 18, a waste toner outlet 19, and/or a protrusion 22.

The waste toner moving mechanism M connects the cleaner 14 or the belt cleaner 12 serving as a cleaner to the waste toner bottle 20 serving as a collection container. The waste toner bottle 20 is detachably attached to the image forming apparatus A depicted in FIG. 1. The waste toner collected by the cleaner 14 or the belt cleaner 12 is sent to the waste toner bottle 20 through the waste toner discharge pipe 18. The hollow, waste toner discharge pipe 18 protrudes from one side of the cleaner 14 or the belt cleaner 12. For example, the waste toner bottle 20 is provided at a position corresponding to the waste toner discharge pipe 18, that is, a position at which the cleaner 14 included in the process cartridge 11*a*, 11*b*, 11*c*, or 11*d* (depicted in FIG. 1 and hereinafter referred to as the process cartridge 11) is detachably attached to the image forming apparatus A. The waste toner bottle 20 has a given interior volume. When the process cartridge 11 is set in the image forming apparatus A, a head of the waste toner discharge pipe 18 is inserted into the waste toner bottle 20.

The waste toner conveying screw 17, serving as a conveyer, is provided inside the cleaner 14 of the process cartridge 11 or the belt cleaner 12 to convey waste toner from the cleaner 14 or the belt cleaner 12 to the head of the waste toner discharge pipe 18. The waste toner outlet 19 is provided in the waste toner discharge pipe 18 at a position near the head of the waste toner discharge pipe 18. The waste toner conveyed by the waste toner conveying screw 17 is discharged into the waste toner bottle 20 through the waste toner outlet 19. The waste toner conveying screw 17, serving as a conveyer for conveying the waste toner from the cleaner 14 or the belt cleaner 12 to the waste toner bottle 20, includes a spiral member, such as a coil spring, provided on a single axis inside the waste toner discharge pipe 18 and extending in a longitudinal direction (e.g., an axial direction) of the waste toner discharge pipe 18. The conveyer for conveying the waste toner is not limited to a screw or a coil having a spiral shape. For example, the conveyer for conveying the waste toner may have a belt shape.

One end of the waste toner conveying screw 17 in a longitudinal direction (e.g., an axial direction) of the waste toner conveying screw 17 contacts waste toner contained in the cleaner 14 or the belt cleaner 12, and another end of the waste toner conveying screw 17 faces the waste toner outlet 19. A driving mechanism drives and rotates the spiral member of the waste toner conveying screw 17 toward the waste toner outlet 19. Thus, the waste toner conveying screw 17 driven and rotated by the driving mechanism forms a waste toner conveyance path for conveying the waste toner from the cleaner 14 or the belt cleaner 12 to the head of the waste toner discharge pipe 18.

Alternatively, instead of discharging waste toner directly from the process cartridge 11 to the waste toner bottle 20, the waste toner may be discharged into a waste toner conveyance path provided inside the body 3 depicted in FIG. 1 temporarily, and then the waste toner may be sent from the waste toner conveyance path to the waste toner bottle 20. In this case, the waste toner conveyance path is provided between the process cartridge 11 and the waste toner bottle 20. In other words, the waste toner bottle 20 may not be provided near the process cartridge 11. Thus, the waste toner bottle 20 and other elements can be disposed inside the image forming apparatus A depicted in FIG. 1 more flexibly.

Further, as illustrated in FIG. 2, one waste toner bottle 20 is provided for each of the process cartridges 11*a*, 11*b*, 11*c*, and 11*d*. Alternatively, one waste toner bottle 20 may be connected to the four process cartridges 11*a*, 11*b*, 11*c*, and 11*d*.

Figure 3B:
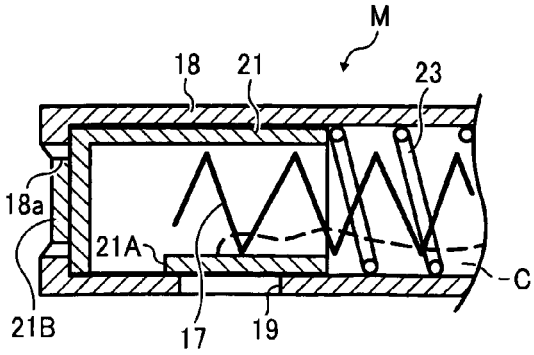
FIG. 3B is a sectional view (according to an example embodiment) of a waste toner moving mechanism included in the cleaning unit shown in FIG. 3A when a waste toner bottle included in the cleaning unit is detached.
Figure 3C:
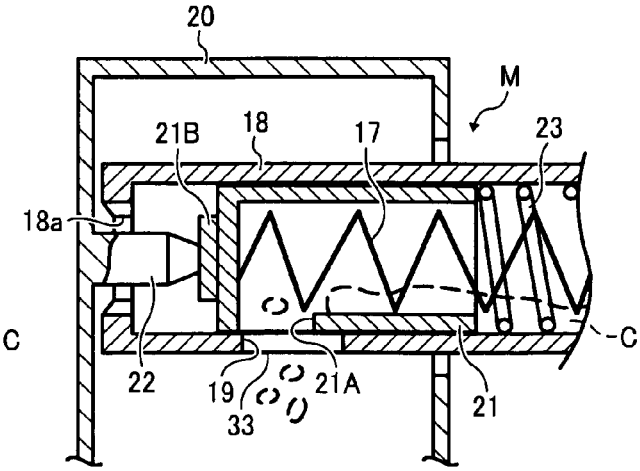
FIG. 3C is a sectional view (according to an example embodiment) of a waste toner moving mechanism included in the cleaning unit shown in FIG. 3A when a waste toner bottle included in the cleaning unit is attached.

FIG. 3B is a sectional view of the waste toner moving mechanism M when the waste toner bottle 20 depicted in FIG. 3A is detached. FIG. 3C is a sectional view of the waste toner moving mechanism M when the waste toner bottle 20 is attached. As illustrated in FIG. 3B, the waste toner moving mechanism M further includes a shutter 21 and/or a spring 23. The waste toner discharge pipe 18 includes a through-hole 18*a*. The shutter 21 includes an opening 21A and/or a step portion 21B. As illustrated in FIG. 3C, the waste toner bottle 20 includes a waste toner inlet 33.

Referring to FIGS. 3A, 3B, and 3C, the following describes the shutter 21. When the waste toner bottle 20 is attached to and detached from the image forming apparatus A depicted in FIG. 1, the shutter 21, serving as an open-close member, opens and closes the waste toner outlet 19 provided in the waste toner discharge pipe 18. As illustrated in FIGS. 3A and 3C, when the waste toner bottle 20 is attached to the cleaner 14 or the belt cleaner 12 depicted in FIG. 3A, and therefore the head of the waste toner discharge pipe 18 is inserted into the waste toner bottle 20, the waste toner outlet 19 is provided in a lower portion of the head of the waste toner discharge pipe 18, which is provided inside the waste toner bottle 20. A part of a circumference of the waste toner discharge pipe 18 is cut into a substantially rectangular shape to form the waste toner outlet 19. The waste toner outlet 19, that is, an opening provided in the waste toner discharge pipe 18, has a size capable of discharging waste toner conveyed in the waste toner discharge pipe 18 out of the waste toner discharge pipe 18 smoothly.

As illustrated in FIGS. 3B and 3C, the shutter 21 is provided inside the waste toner discharge pipe 18 in such a manner that the shutter 21 moves coaxially with the waste toner discharge pipe 18 in the longitudinal direction of the waste toner discharge pipe 18. When the waste toner bottle 20 is attached to and detached from the image forming apparatus A, the shutter 21 opens and closes the waste toner outlet 19. Namely, when the waste toner bottle 20 is not attached to the image forming apparatus A as illustrated in FIG. 3B, the shutter 21 closes the waste toner outlet 19.

The shutter 21 has a substantially cylindrical shape with a bottom, which has an outer diameter slightly smaller than an inner diameter of the waste toner discharge pipe 18. The opening 21A is provided in an end of a circumference of the shutter 21, and has a size smaller than the size of the waste toner outlet 19. A rim of one end, which is disposed opposite the bottom, of the shutter 21 contacts one end (e.g., a left end in FIG. 3B) of the spring 23. The spring 23 constantly applies pressure to the shutter 21 to move the opening 21A leftward in FIG. 3B to a close position at which the opening 21A separates from the waste toner outlet 19. The spring 23 has an outer diameter (e.g., a spring diameter) slightly smaller than the inner diameter of the waste toner discharge pipe 18. Another end (e.g., a right end not shown in FIG. 3B) of the spring 23 is fixedly mounted on the waste toner discharge pipe 18 in such a manner that the spring 23 is compressed to have a length smaller than a natural length applied with no load. An elastic return force of the spring 23 is applied to the shutter 21 leftward in FIG. 3B. A gap is provided between the spring 23 and the waste toner conveying screw 17 provided inside the spring 23 so that movement of the spring 23 does not interfere with movement of the waste toner conveying screw 17.

The through-hole 18*a* is provided at a substantially center portion on a circular bottom of the waste toner discharge pipe 18 provided in the head of the waste toner discharge pipe 18, and penetrates the circular bottom of the waste toner discharge pipe 18. As illustrated in FIG. 3A, the protrusion 22 is provided in the waste toner bottle 20 provided on the left of the cleaner 14 or the belt cleaner 12 in FIG. 3A, that is, on the front of the image forming apparatus A depicted in FIG. 1. The protrusion 22 corresponds to the through-hole 18*a* of the waste toner discharge pipe 18, and has a given length to serve as an engaging member for engaging the through-hole 18*a*. In other words, the protrusion 22 protrudes from an interior wall of the waste toner bottle 20 at a position on the interior wall of the waste toner bottle 20 opposing the waste toner discharge pipe 18 inserted into the waste toner bottle 20. Namely, the protrusion 22 protrudes in a direction opposite to an insertion direction in which the waste toner discharge pipe 18 is inserted into the waste toner bottle 20. The protrusion 22 protrudes for a length enough to move the shutter 21 to an open position at which the opening 21A corresponds to the waste toner outlet 19 as illustrated in FIG. 3C according to a length of the waste toner discharge pipe 18 inserted into the waste toner bottle 20. In other words, when the waste toner discharge pipe 18 is inserted into the waste toner bottle 20, the protrusion 22 penetrates the through-hole 18*a*, and a point of the protrusion 22 contacts the shutter 21, as illustrated in FIG. 3C. When the waste toner discharge pipe 18 is inserted into the waste toner bottle 20 further, the protrusion 22 moves the shutter 21 so that the opening 21A of the shutter 21 corresponds to the waste toner outlet 19 provided in the waste toner discharge pipe 18.

The step portion 21B, which has an outer diameter slightly smaller than an inner diameter of the through-hole 18*a*, is provided on one end of the shutter 21 in the axial direction of the waste toner conveying screw 17. When the waste toner bottle 20 is not attached to the waste toner discharge pipe 18 as illustrated in FIG. 3B, the step portion 21B of the shutter 21 is disposed inside the through-hole 18*a*. Thus, the step portion 21B of the shutter 21 is provided in a path connecting the through-hole 18*a* to an inside of the waste toner discharge pipe 18 to prevent or reduce waste toner leaking from the waste toner discharge pipe 18 to an outside of the waste toner discharge pipe 18 through the through-hole 18*a*.

Accordingly, when the process cartridge 11 and the waste toner bottle 20 are attached to the image forming apparatus A, the protrusion 22 provided in the waste toner bottle 20 presses the shutter 21 to open the waste toner outlet 19 so that waste toner C is discharged from the cleaner 14 included in the process cartridge 11 or the belt cleaner 12 into the waste toner bottle 20 through the waste toner inlet 33 as illustrated in FIG. 3C. For example, when the process cartridge 11 and the waste toner bottle 20 are attached to the image forming apparatus A, the opening 21A of the shutter 21 corresponds to (e.g., overlaps) the waste toner outlet 19 provided in the waste toner discharge pipe 18 as illustrated in FIG. 3C. In other words, blocking the waste toner outlet 19 by the shutter 21 is released. Consequently, the waste toner outlet 19 is opened, and the waste toner C contained in the waste toner discharge pipe 18 is discharged through the waste toner outlet 19.

On the other hand, when the waste toner bottle 20 is not attached to the image forming apparatus A, the spring 23 applies pressure to the shutter 21 to move the shutter 21 toward the head of the waste toner discharge pipe 18. Accordingly, the opening 21A of the shutter 21 does not correspond to the waste toner outlet 19 provided in the waste toner discharge pipe 18 as illustrated in FIG. 3B. Consequently, a circumferential wall of the shutter 21 blocks the waste toner outlet 19, and the waste toner C contained in the waste toner discharge pipe 18 is not discharged through the waste toner outlet 19.

Figure 4:
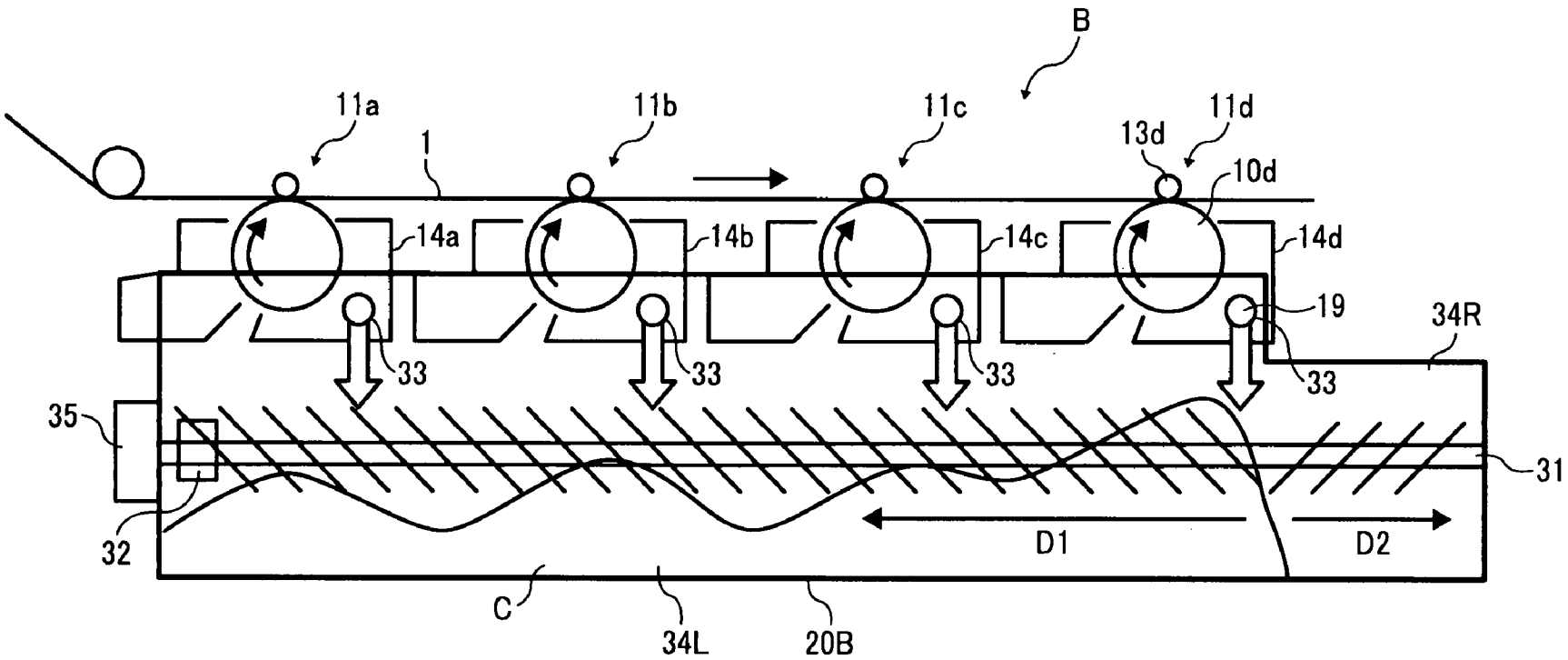
FIG. 4 is a schematic view of an image forming apparatus according to another example embodiment.

Referring to FIG. 4, the following describes an image forming apparatus B including a single waste toner bottle 20B for receiving waste toner sent from the four process cartridges 11*a*, 11*b*, 11*c*, and 11*d*. FIG. 4 is a schematic view of the image forming apparatus B. As illustrated in FIG. 4, the image forming apparatus B includes the waste toner bottle 20B instead of the waste toner bottles 20 depicted in FIG. 2. The waste toner bottle 20B includes a leveling member 31, a detector 32, waste toner inlets 33, a right space 34R, a left space 34L, and/or a leveling member driver 35. The other elements of the image forming apparatus B are equivalent to the elements of the image forming apparatus A depicted in FIG. 1.

The waste toner bottle 20B, serving as a collection container, includes a plurality of inlets (e.g., the waste toner inlets 33) corresponding to a number of the cleaners (e.g., the cleaners 14*a*, 14*b*, 14*c*, and 14*d*), so as to receive waste toner C discharged from the cleaners 14*a*, 14*b*, 14*c*, and 14*d*. For example, the waste toner inlets 33 of the waste toner bottle 20B are connected to the waste toner outlets 19 of the process cartridges 14*a*, 14*b*, 14*c*, and 14*d*, respectively. Waste toner C is sent from the cleaners 14*a*, 14*b*, 14*c*, and 14*d* to the waste toner bottle 20B through the waste toner outlets 19 and the waste toner inlets 33.

The leveling member 31, serving as a leveling member for leveling waste toner C contained in the waste toner bottle 20B, is provided inside the waste toner bottle 20B at a position substantially immediately below the waste toner outlets 19 for the cleaners 14*a*, 14*b*, 14*c*, and 14*d*. The leveling member 31 is driven by the leveling member driver 35 to even out waste toner C accumulated immediately below the waste toner outlets 19 and convey the waste toner C. In other words, the leveling member 31 levels mountains of waste toner C formed immediately below the waste toner outlets 19. The leveling member 31 may include a coil. However, the leveling member 31 may preferably include a screw to send waste toner C to the detector 32 or to provide flexibility in design. Alternatively, the leveling member 31 may include a screw mounted with a paddle.

The screw of the leveling member 31 conveys waste toner C toward the detector 32 as well as levels or evens out the waste toner C accumulated in the waste toner bottle 20B. The detector 32 is provided inside the waste toner bottle 20B to detect an amount of waste toner C contained in the waste toner bottle 20B. The detector 32 may include a transparent window provided on the waste toner bottle 20B and a photo sensor provided in the image forming apparatus A depicted in FIG. 1. The photo sensor detects waste toner C accumulated in the waste toner bottle 20B and therefore shielding light through the transparent window to determine whether or not an amount of the accumulated waste toner C reaches a reference amount. Alternatively, the detector 32 may include a thin rubber seal provided inside the waste toner bottle 20B. The detector 32 detects the rubber seal deformed by waste toner C pressed into the rubber seal. Yet alternatively, the detector 32 may detect a weight of the waste toner bottle 20B containing waste toner C to determine whether or not an amount of the waste toner C contained in the waste toner bottle 20B reaches a reference amount. The detector 32 may preferably include the rubber seal to avoid an erroneous detection caused by waste toner C flying inside the waste toner bottle 20B and staining the transparent window.

The leveling member 31, which levels or evens out the waste toner C accumulated inside the waste toner bottle 20B and conveys the waste toner C, is provided in an upper portion of the waste toner bottle 20B. When the waste toner C is accumulated up to a height of the leveling member 31 to have a mountain shape, the leveling member 31 conveys the waste toner C having the mountain shape toward the detector 32. Accordingly, the waste toner bottle 20B can contain an increased amount of waste toner C. By contrast, when the leveling member 31 is provided in a lower portion of the waste toner bottle 20B, the leveling member 31 conveys the waste toner C toward the detector 32 before the waste toner C is accumulated to have a mountain shape or when the waste toner C is accumulated to have a low mountain shape. Accordingly, a volume or a capacity of the waste toner bottle 20B may not be utilized.

The detector 32 may be provided at a position farthest from the waste toner outlet 19 for the cleaner 14*d* included in the process cartridge 11*d* serving as an image station for forming a black toner image, which is used more frequently than the process cartridges 11*a*, 11*b*, and 11*c*. Thus, the waste toner bottle 20B can contain an increased amount of black waste toner C. In other words, when the process cartridge 11*d* is used more frequently than the process cartridges 11*a*, 11*b*, and 11*c*, the waste toner bottle 20B can store an increased amount of waste toner C.

When the detector 32 detects the waste toner C, a control panel provided on the body 3 depicted in FIG. 1 may display a message prompting a user to replace the waste toner bottle 20B with a new one or another empty toner bottle, and may stop a print operation of the image forming apparatus A depicted in FIG. 1. Alternatively, the control panel may preferably display a message advising the user that the waste toner bottle 20B is almost full, and may allow the print operation of the image forming apparatus A for a given time period after the detector 32 detects the waste toner C to improve operation efficiency, because the waste toner bottle 20B is not full when the detector 32 detects the waste toner C.

The waste toner bottle 20B includes the right space 34R for containing the waste toner C in one side of the waste toner bottle 20B in a longitudinal direction of the waste toner bottle 20B (e.g., an axial direction of the leveling member 31) opposite to another side provided with the detector 32 at a position on the right in FIG. 4 of a portion of the waste toner bottle 20B provided immediately below the process cartridge 11*d*, so as to increase the volume or the capacity of the waste toner bottle 20B. In a region of the waste toner bottle 20B near a position immediately below the waste toner outlet 19 for the cleaner 14*d* included in the process cartridge 11*d*, a conveyance direction for conveying the waste toner C is branched into two directions, which are a direction D1 to move toward the detector 32 and a direction D2 to move away from the detector 32. Accordingly, a substantial amount of waste toner C is collected into the right space 34R of the waste toner bottle 20B. However, a detector for detecting the waste toner C is not provided in the right space 34R of the waste toner bottle 20B. The waste toner C sent to the right space 34R of the waste toner bottle 20B moves on an interior wall of the waste toner bottle 20B and moves toward the detector 32.

In the region near the position immediately below the waste toner outlet 19 for the cleaner 14*d* included in the process cartridge 11*d*, at which the conveyance direction for conveying the waste toner C is branched into the two directions D1 and D2, black waste toner C discharged from the process cartridge 11*d* enters the waste toner bottle 20B. Accordingly, an increased amount of waste toner C is accumulated in the region near the position immediately below the waste toner outlet 19 compared to when the waste toner C is conveyed in one direction. When a conveyance capacity for conveying the waste toner C in the direction D2 is greater than a conveyance capacity for conveying the waste toner C in the direction D1, the black waste toner C discharged from the waste toner outlet 19 for the cleaner 14*d* forms a high mountain of the black waste toner C below the waste toner outlet 19. To address this, the conveyance capacity for conveying the waste toner C in the direction D2 is adjusted to be smaller than the conveyance capacity for conveying the waste toner C in the direction D1. Accordingly, even when the right space 34R provided on the right of the region of the waste toner bottle 20B immediately below the waste toner outlet 19 for the cleaner 14*d* is full of waste toner C, the conveyance capacity for conveying the waste toner C in the direction D1, which is greater than the conveyance capacity for conveying the waste toner C in the direction D2, prevents formation of the high mountain of the black waste toner C below the waste toner outlet 19 for the cleaner 14*d*, thus preventing the waste toner C from overflowing the waste toner bottle 20B.

Figure 5:
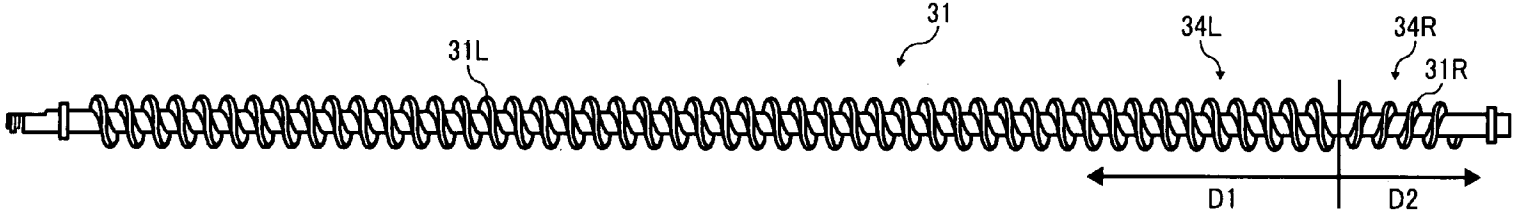
FIG. 5 is a perspective view (according to an example embodiment) of a leveling member included in the image forming apparatus shown in FIG. 4, which has an example shape.
Figure 6:
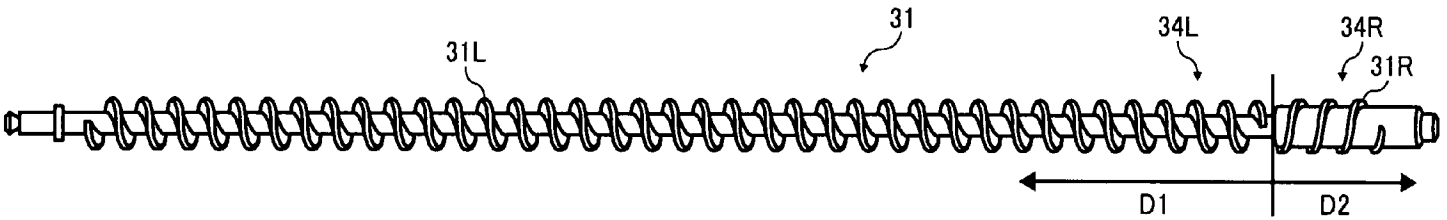
FIG. 6 is a perspective view (according to an example embodiment) of a leveling member included in the image forming apparatus shown in FIG. 4, which has another example shape.
Figure 7:
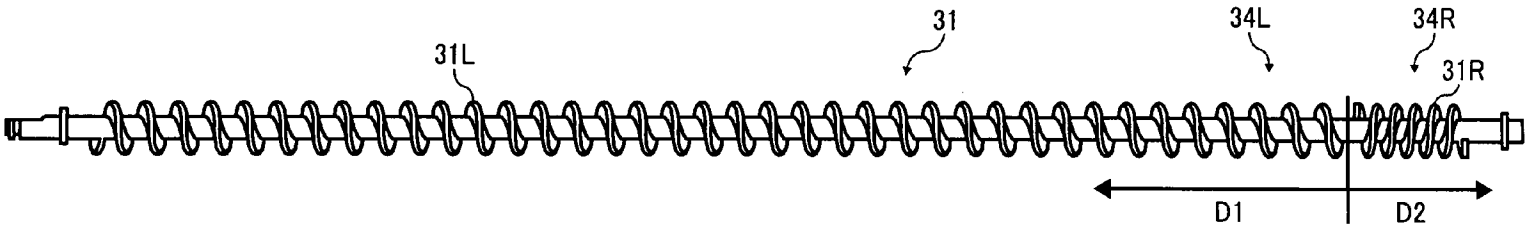
FIG. 7 is a perspective view (according to an example embodiment) of a leveling member included in the image forming apparatus shown in FIG. 4, which has yet another example shape.

Referring to FIGS. 5 to 7, the following describes a structure of the leveling member 31 for adjusting the conveyance capacity for conveying the waste toner C in the directions D1 and D2. FIG. 5 is a perspective view of the leveling member 31 having an example shape. FIG. 6 is a perspective view of the leveling member 31 having another example shape. FIG. 7 is a perspective view of the leveling member 31 having yet another example shape. As illustrated in FIGS. 5 to 7, the leveling member 31 includes a left portion 31L and/or a right portion 31R.

As illustrated in FIG. 5, the leveling member 31 may have different screw diameters. For example, the left portion 31L (e.g., a first portion) of the leveling member 31 provided in the left space 34L in which the leveling member 31 conveys the waste toner C in the direction D1 has a screw diameter greater than a screw diameter of the right portion 31R (e.g., a second portion) of the leveling member 31 provided in the right space 34R in which the leveling member 31 conveys the waste toner C in the direction D2. Thus, the greater screw diameter of the left portion 31L of the leveling member 31 provided in the left space 34L provides a conveyance capacity for conveying the waste toner C in the direction D1 greater than a conveyance capacity of the right portion 31R of the leveling member 31 having the smaller screw diameter for conveying the waste toner C in the direction D2 in the right space 34R.

As illustrated in FIG. 6, the leveling member 31 may have different screw shaft diameters. For example, the left portion 31L (e.g., a first portion) of the leveling member 31 provided in the left space 34L in which the leveling member 31 conveys the waste toner C in the direction D1 has a screw shaft diameter smaller than a screw shaft diameter of the right portion 31R (e.g., a second portion) of the leveling member 31 provided in the right space 34R in which the leveling member 31 conveys the waste toner C in the direction D2 while the screw diameter of the left portion 31L of the leveling member 31 provided in the left space 34L is identical with the screw diameter of the right portion 31R of the leveling member 31 provided in the right space 34R. Thus, the smaller screw shaft diameter of the left portion 31L of the leveling member 31 provided in the left space 34L provides a conveyance capacity for conveying the waste toner C in the direction D1 greater than a conveyance capacity of the right portion 31R of the leveling member 31 having the greater screw shaft diameter for conveying the waste toner C in the direction D2 in the right space 34R.

As illustrated in FIG. 7, the leveling member 31 may have different screw pitches. For example, the left portion 31L (e.g., a first portion) of the leveling member 31 provided in the left space 34L in which the leveling member 31 conveys the waste toner C in the direction D1 has a screw pitch greater than a screw pitch of the right portion 31R (e.g., a second portion) of the leveling member 31 provided in the right space 34R in which the leveling member 31 conveys the waste toner C in the direction D2. Thus, the greater screw pitch of the left portion 31L of the leveling member 31 provided in the left space 34L provides a conveyance capacity for conveying the waste toner C in the direction D1 greater than a conveyance capacity of the right portion 31R of the leveling member 31 having the smaller screw pitch for conveying the waste toner C in the direction D2 in the right space 34R.

The conveyance capacity of the leveling member 31 can be adjusted by a conveyance area of the leveling member 31 for conveying the waste toner C, which varies depending on a changed screw diameter or a changed screw shaft diameter of the leveling member 31. Further, the conveyance capacity of the leveling member 31 can be adjusted by a conveyance distance of the leveling member 31 for conveying the waste toner C per one rotation of the leveling member 31, which varies depending on a changed screw pitch of the leveling member 31.

As described above, an image forming apparatus (e.g., the image forming apparatus A depicted in FIG. 1 or the image forming apparatus B depicted in FIG. 4) includes a cleaning unit (e.g., the cleaning unit 24 depicted in FIG. 3A).

The cleaning unit includes a cleaner (e.g., the cleaner 14 or the belt cleaner 12 depicted in FIG. 3A), a collection container (e.g., the waste toner bottle 20 depicted in FIG. 3A or the waste toner bottle 20B depicted in FIG. 4), and a conveyer (e.g., the waste toner conveying screw 17 depicted in FIG. 3A). The cleaner is detachably attached to the image forming apparatus, and collects waste toner. The collection container is detachably attached to the image forming apparatus, and collects and contains the waste toner collected by the cleaner. The conveyer conveys the waste toner collected by the cleaner to the collection container.

In the collection container for collecting and containing the waste toner not used for an image forming process, a leveling member (e.g., the leveling member 31 depicted in FIG. 4) levels the waste toner contained in the collection container. A detector (e.g., the detector 32 depicted in FIG. 4) detects an amount of the waste toner contained in the collection container. The leveling member levels the waste toner delivered to the collection container through at least one inlet (e.g., the waste toner inlet 33 depicted in FIG. 4) by conveying the waste toner simultaneously in two opposite directions, which are a first direction (e.g., the direction D1 depicted in FIG. 4) toward the detector and a second direction (e.g., the direction D2 depicted in FIG. 4) opposite to the first direction, starting from an origination position corresponding to the at least one inlet. Accordingly, a volume or a capacity of the collection container can be utilized to collect and contain an increased amount of waste toner.

A conveyance capacity of the leveling member for conveying the waste toner in the first direction toward the detector is greater than a conveyance capacity of the leveling member for conveying the waste toner in the second direction opposite to the first direction. Accordingly, even when a part of the waste toner is conveyed in the second direction, the detector detects an amount of the waste toner contained in the collection container precisely to prevent the waste toner from overflowing the collection container.

The origination position corresponding to the at least one inlet from which the leveling member conveys the waste toner in the first direction and the second direction is located at a portion of the collection container substantially below an inlet farthest from the detector. In other words, when the collection container includes a plurality of inlets, the leveling member conveys the waste toner in the first direction and the second direction from a position corresponding to an inlet provided farthest from the detector. Thus, even when an amount of waste toner delivered to the collection container through the plurality of inlets varies, the waste toner does not overflow the collection container.

The leveling member includes a screw having a spiral wing. A first portion (e.g., the left portion 31L depicted in FIG. 5) of the screw for conveying the waste toner in the first direction toward the detector may have a screw diameter greater than a screw diameter of a second portion (e.g., the right portion 31R depicted in FIG. 5) of the screw for conveying the waste toner in the second direction opposite to the first direction.

Alternatively, the first portion of the screw for conveying the waste toner in the first direction toward the detector may have a conveyance area greater than a conveyance area of the second portion of the screw for conveying the waste toner in the second direction opposite to the first direction.

Yet alternatively, the first portion of the screw for conveying the waste toner in the first direction toward the detector may have a screw pitch greater than a screw pitch of the second portion of the screw for conveying the waste toner in the second direction opposite to the first direction. Thus, the conveyance capacity of the leveling member for conveying the waste toner in the first direction and the second direction can be adjusted precisely.

According to the above-described example embodiments, the image forming apparatus A or B functions as a color printer for forming a color image. Alternatively, the image forming apparatus A or B may function as a monochrome printer. Yet alternatively, the image forming apparatus A or B may function as a copier, a facsimile machine, a multifunction printer, or the like.

As illustrated in FIG. 3A, according to the above-described example embodiments, the waste toner bottle 20 or 20B is attached to the cleaner 14 included in the process cartridge 11*a*, 11*b*, 11*c*, or 11*d* (depicted in FIG. 1) or the belt cleaner 12 to serve as the cleaning unit 24 (depicted in FIG. 2) for cleaning the photoconductive drum 10*a*, 10*b*, 10*c*, or 10*d* included in the process cartridge 11*a*, 11*b*, 11*c*, or 11*d*, respectively, or the intermediate transfer belt 1 (depicted in FIG. 1). Alternatively, the waste toner bottle 20 or 20B may be attached to the development device 16*a*, 16*b*, 16*c*, or 16*d* (depicted in FIG. 2) to receive developer discharged from the development device 16*a*, 16*b*, 16*c*, or 16*d*. Yet alternatively, the waste toner bottle 20 or 20B may be attached to a transfer device to receive waste toner discharged from the transfer device. Yet alternatively, the waste toner bottle 20 or 20B may be applied to a system combining the process cartridges 11*a*, 11*b*, 11*c*, and 11*d*, the intermediate transfer belt 1, the development devices 16*a*, 16*b*, 16*c*, and 16*d*, and the transfer device.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A collection container for collecting and containing waste toner, comprising:

a leveling member configured to level the waste toner contained in the collection container;

a detector configured to detect an amount of the waste toner contained in the collection container; and a plurality of inlets through which waste toner is configured to be delivered to the collection container, the leveling member configured to level the waste toner delivered to the collection container through the plurality of inlets by conveying the waste toner simultaneously in a first direction toward the detector and a second direction opposite to the first direction, the second direction being away from the detector, the first and second directions starting from an origination position below a first inlet of the plurality of inlets, the first inlet being configured to receive waste toner of a most frequently used toner, and a conveyance capacity of the leveling member for conveying the waste toner in the first direction toward the detector being greater than a conveyance capacity of the leveling member for conveying the waste toner in the second direction opposite to the first direction.

2. The collection container according to claim 1, wherein the origination position from which the leveling member is configured to convey the waste toner in the first direction and the second direction is located at a portion of the collection container substantially below an inlet farthest from the detector.

3. The collection container according to claim 1, wherein the leveling member includes a screw having a spiral wing, and a first portion of the screw for conveying the waste toner in the first direction toward the detector has a screw diameter greater than a screw diameter of a second portion of the screw for conveying the waste toner in the second direction opposite to the first direction.

4. The collection container according to claim 1, wherein the leveling member includes a screw having a spiral wing, and a first portion of the screw for conveying the waste toner in the first direction toward the detector has a conveyance area greater than a conveyance area of a second portion of the screw for conveying the waste toner in the second direction opposite to the first direction.

5. The collection container according to claim 1, wherein the leveling member includes a screw having a spiral wing, and a first portion of the screw for conveying the waste toner in the first direction toward the detector has a screw pitch greater than a screw pitch of a second portion of the screw for conveying the waste toner in the second direction opposite to the first direction.

6. A cleaning unit comprising:

a cleaner configured to collect waste toner;

a collection container configured to collect and contain the waste toner collected by the cleaner; and a conveyer configured to convey the waste toner collected by the cleaner to the collection container, the collection container including:

a leveling member configured to level the waste toner contained in the collection container;

a detector configured to detect an amount of the waste toner contained in the collection container; and a plurality of inlets through which waste toner conveyed by the conveyer is configured to be delivered to the collection container, the leveling member configured to level the waste toner delivered to the collection container through the plurality of inlets by conveying the waste toner simultaneously in a first direction toward the detector and a second direction opposite to the first direction, the second direction being away from the detector, the first and second directions starting from an origination position below a first inlet of the plurality of inlets, the first inlet being configured to receive waste toner of a most frequently used toner, and a conveyance capacity of the leveling member for conveying the waste toner in the first direction toward the detector being greater than a conveyance capacity of the leveling member for conveying the waste toner in the second direction opposite to the first direction.

7. The cleaning unit according to claim 6, wherein the origination position from which the leveling member is configured to convey the waste toner in the first direction and the second direction is located at a portion of the collection container substantially below an inlet farthest from the detector.

8. The cleaning unit according to claim 6, wherein the leveling member includes a screw having a spiral wing, and a first portion of the screw for conveying the waste toner in the first direction toward the detector has a screw diameter greater than a screw diameter of a second portion of the screw for conveying the waste toner in the second direction opposite to the first direction.

9. The cleaning unit according to claim 6, wherein the leveling member includes a screw having a spiral wing, and a first portion of the screw for conveying the waste toner in the first direction toward the detector has a conveyance area greater than a conveyance area of a second portion of the screw for conveying the waste toner in the second direction opposite to the first direction.

10. The cleaning unit according to claim 6, wherein the leveling member includes a screw having a spiral wing, and a first portion of the screw for conveying the waste toner in the first direction toward the detector has a screw pitch greater than a screw pitch of a second portion of the screw for conveying the waste toner in the second direction opposite to the first direction.

11. An image forming apparatus comprising: a collection container detachably attached to the image forming apparatus to collect and contain waste toner, the collection container comprising:

a leveling member configured to level the waste toner contained in the collection container;

a detector configured to detect an amount of the waste toner contained in the collection container; and a plurality of inlets through which waste toner is configured to be delivered to the collection container, the leveling member configured to level the waste toner delivered to the collection container through the plurality of inlets by conveying the waste toner simultaneously in a first direction toward the detector and a second direction opposite to the first direction, the second direction being away from the detector, the first and second directions starting from an origination position below a first inlet of the plurality of inlets, the first inlet being configured to receive waste toner of a most frequently used toner, and a conveyance capacity of the leveling member for conveying the waste toner in the first direction toward the detector being greater than a conveyance capacity of the leveling member for conveying the waste toner in the second direction opposite to the first direction.

12. The image forming apparatus according to claim 11, wherein the origination position from which the leveling member is configured to convey the waste toner in the first direction and the second direction is located at a portion of the collection container substantially below an inlet farthest from the detector.

13. The image forming apparatus according to claim 11, wherein the leveling member includes a screw having a spiral wing, and a first portion of the screw for conveying the waste toner in the first direction toward the detector has a screw diameter greater than a screw diameter of a second portion of the screw for conveying the waste toner in the second direction opposite to the first direction.

14. The image forming apparatus according to claim 11, wherein the leveling member includes a screw having a spiral wing, and a first portion of the screw for conveying the waste toner in the first direction toward the detector has a conveyance area greater than a conveyance area of a second portion of the screw for conveying the waste toner in the second direction opposite to the first direction.

15. The image forming apparatus according to claim 11, wherein the leveling member includes a screw having a spiral wing, and a first portion of the screw for conveying the waste toner in the first direction toward the detector has a screw pitch greater than a screw pitch of a second portion of the screw for conveying the waste toner in the second direction opposite to the first direction.

* * * * *